US006808093B1

(12) United States Patent
Lin et al.

(10) Patent No.: US 6,808,093 B1
(45) Date of Patent: Oct. 26, 2004

(54) HANGER ASSEMBLY

(76) Inventors: Liang-An Lin, No. 33, Lane 115, Shen-Lin S. Rd., Ta-Ya Hsiang, Taichung Hsien (TW); Ching-Hui Chen, No. 33, Lane 115, Shen-Lin S. Rd., Ta-Ya Hsiang, Taichung Hsien (TW)

( * ) Notice: Subject to any disclaimer, the term of this patent is extended or adjusted under 35 U.S.C. 154(b) by 0 days.

(21) Appl. No.: 10/617,633

(22) Filed: Jul. 11, 2003

(51) Int. Cl.[7] ..... A41D 27/22
(52) U.S. Cl. ..... 223/85; 297/188.03
(58) Field of Search ..... 223/85; 297/188.03, 297/188.06, 188.01, 188.04, 188.05, 188.21

(56) References Cited

U.S. PATENT DOCUMENTS 1,722,122 A * 7/1929 Wilson ..... 211/106
2,255,973 A * 9/1941 Hoobler ..... 211/119.007
4,957,230 A * 9/1990 Gonzales ..... 224/560
5,058,790 A * 10/1991 LaVelle ..... 224/275
6,220,489 B1 * 4/2001 Sato ..... 223/94

* cited by examiner

*Primary Examiner*—Gary L. Welch
*Assistant Examiner*—James G Smith
(74) *Attorney, Agent, or Firm*—Kramer, Levin, Naftalis & Frankel LLP

(57) ABSTRACT

A hanger assembly includes a mounting seat, a hooking member extending upwardly from the mounting seat and adapted to engage a backrest of a chair, first and second extendable arms connected pivotally to the mounting seat, an upright bar coupled to the mounting seat and displaceable in an upright direction relative to the mounting seat, and a hanging member disposed on the upright bar.

11 Claims, 8 Drawing Sheets

HANGER ASSEMBLY

BACKGROUND OF THE INVENTION

1. Field of the Invention

The invention relates to a hanger assembly, more particularly to a clothes hanger assembly that is attachable to the backrest of a chair and that has an extendable and foldable arm unit and a position-adjustable upright bar.

2. Description of the Related Art

Restaurants and offices are generally not provided with wardrobes for hanging garments, such as coats. It is therefore a common practice to drape a coat over the backrest of a chair, which may result in wrinkling of the coat when being sat upon or dropping of the coat to the floor. In addition, if the coat is long, it may touch the floor and get dirty.

SUMMARY OF THE INVENTION

Therefore, the main object of the present invention is to provide a hanger assembly that can be attached to the backrest of a chair, that is provided with extendable arms and an adjustable upright bar to facilitate hanging of garments of different lengths in a neat manner, and that is foldable to facilitate carrying and storage.

Accordingly, a hanger assembly of the present invention is adapted for hanging from a backrest of a chair, the backrest having a top edge and two opposite lateral edges. The hanger assembly includes:

a mounting member including a mounting seat extending in an upright direction and having front and rear side surfaces that are respectively distal from and proximate to the backrest and that are opposite to each other in a first direction that is transverse to the upright direction;

a hooking member extending upwardly from the mounting seat and terminating at a hook that is adapted to engage the top edge of the backrest;

a gripping arm unit coupled to the mounting seat and including a first arm of a length, the first arm having proximate and distal segments relative to the mounting seat, the distal segment being disposed to be position-adjustable relative to the proximate segment along the length such that when the first arm extends in a second direction transverse to both the upright direction and the first direction in a position of use, the distal segment is movable toward the proximate segment so as to be adapted to be pushed against a respective one of the lateral edges of the backrest, thereby firmly arresting movement of the mounting member relative to the chair;

an upright bar coupled to the mounting seat and extending in the upright direction; and a hanging member disposed on the upright bar and adapted for hanging an article.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
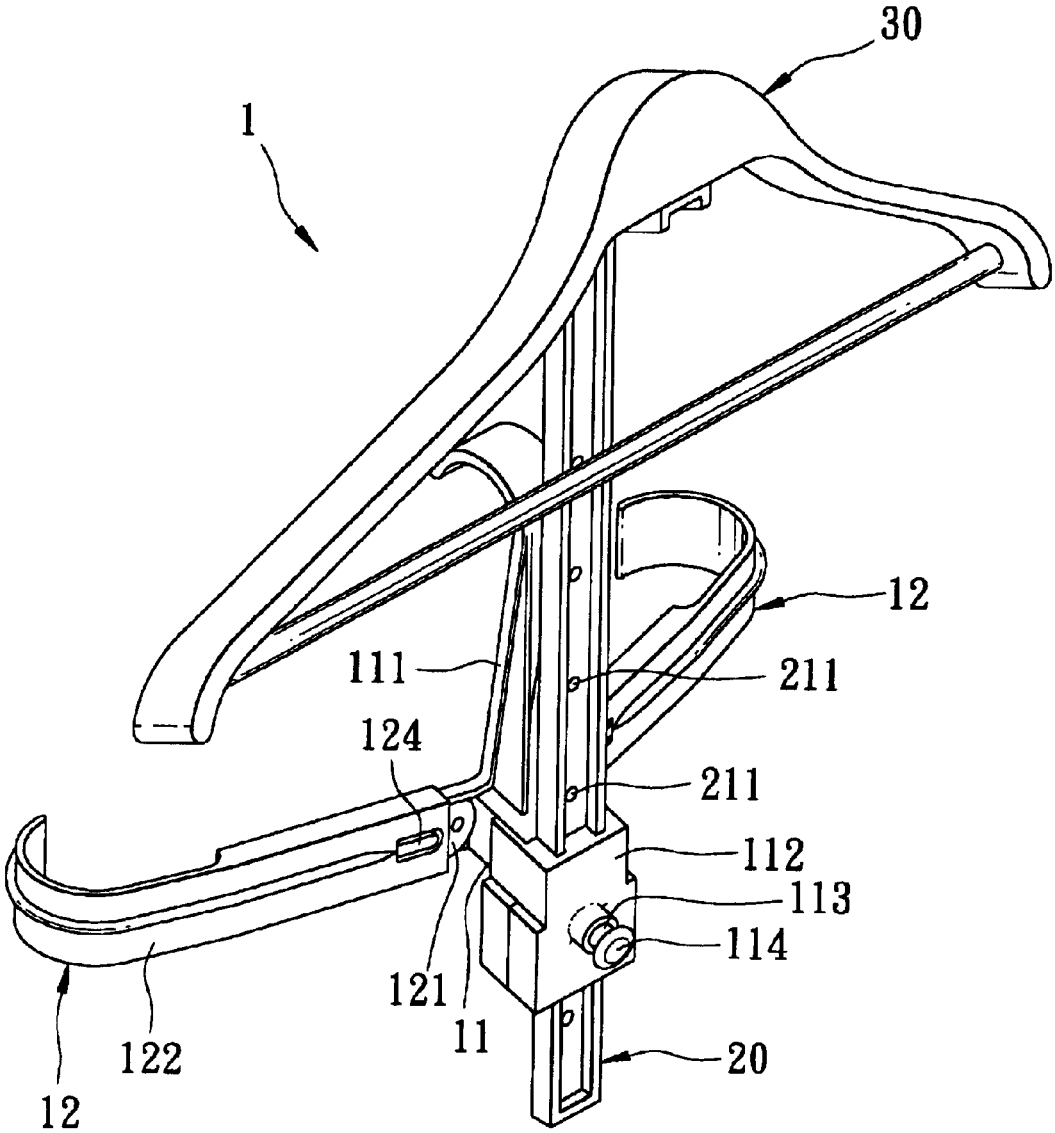
FIG. 1 is a perspective view of the first preferred embodiment of a hanger assembly according to the present invention.

Before the present invention is described in greater detail, it should be noted that like elements are denoted by the same reference numerals throughout the disclosure.

Figure 2:
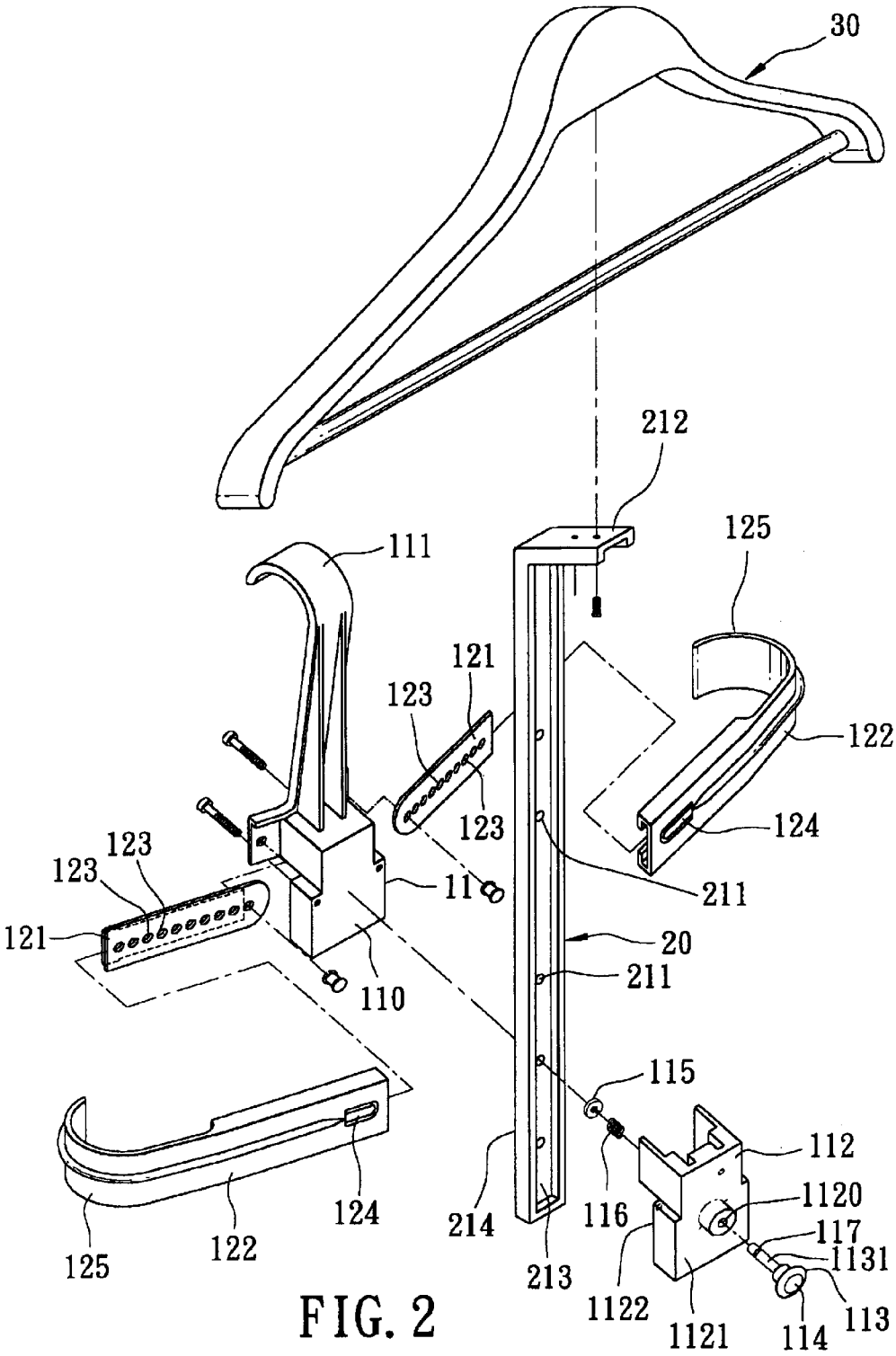
FIG. 2 is an exploded perspective view of the first preferred embodiment.
Figure 3:
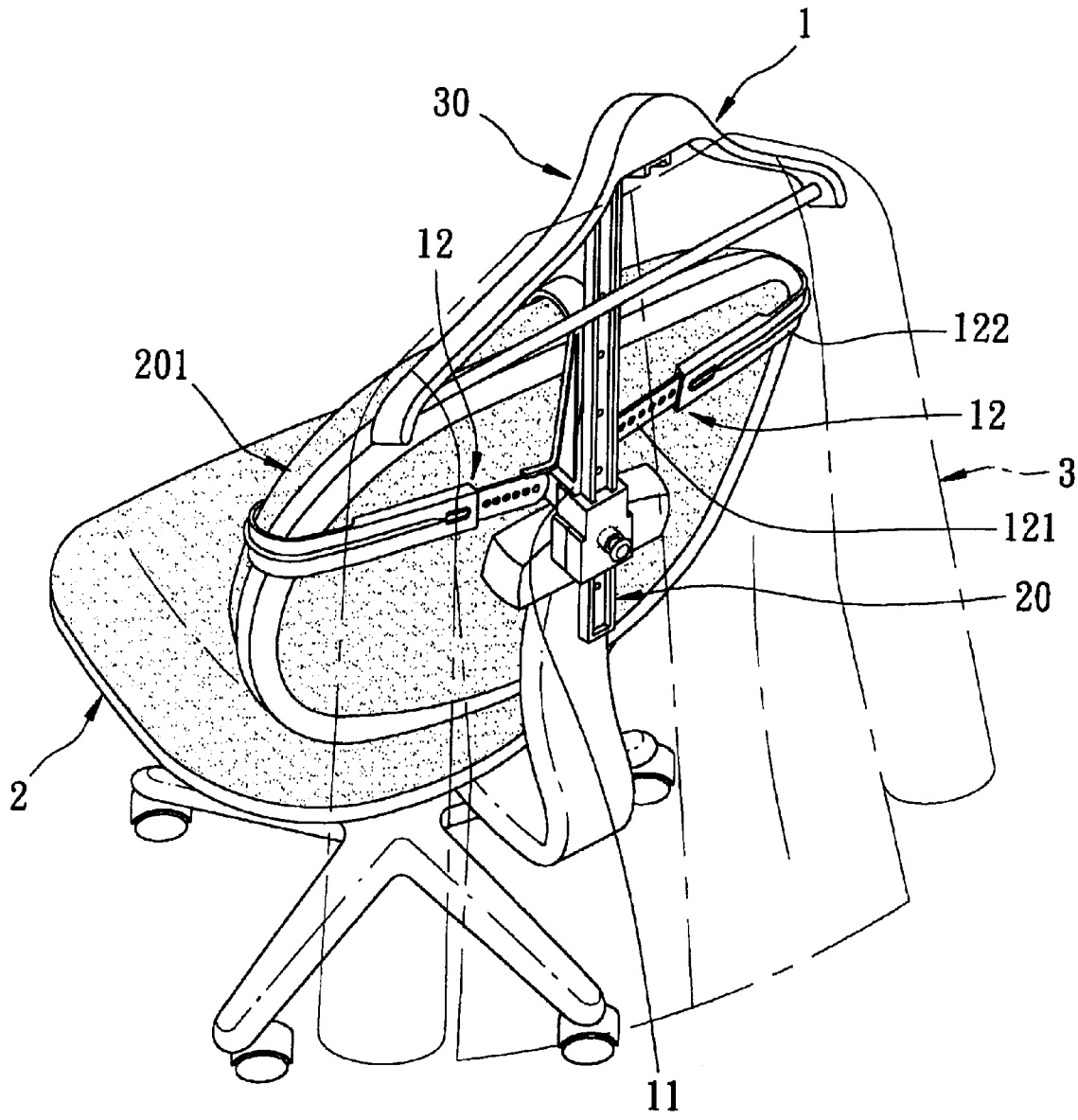
FIG. 3 is a perspective view illustrating the first preferred embodiment in a state of use.

Referring to FIGS. 1, 2 and 3, the first preferred embodiment of a hanger assembly 1 according to the present invention is shown to include a mounting member, a hooking member 111, a gripping arm unit, an upright bar 20, and a hanging member 30. The hanger assembly 1 is adapted for attachment to a backrest 201 of a chair 2 for hanging a garment 3, such as a coat (see FIG. 3).

The mounting member includes a mounting seat 11 extending in an upright direction, and has a front side surface 110 and a rear side surface, which are adapted to be disposed distal from and proximate to the backrest 201 of the chair 2, respectively, and which are opposite to each other in a first direction that is transverse to the upright direction.

The hooking member 111 extends upwardly from the mounting seat 11 and terminates at a hook that is adapted to engage a top edge of the backrest 201 of the chair 2.

The gripping arm unit is coupled to the mounting seat 11, and is extendable and retractable in a second direction transverse to the first direction. The gripping arm unit includes first and second arms 12 connected respectively to two opposite sides of the mounting seat 11. Each of the first and second arms 12 has a predetermined length, and proximate and distal segments 121, 122 relative to the mounting seat 11. As the first and second arms 12 are symmetrical in construction, only one will be described in detail hereinafter. The proximate segment 121 is connected pivotally to the mounting seat 11 so as to be turnable relative to the mounting seat 11, and is provided with a series of spaced-apart retaining holes 123 along the length. The distal segment 122 is disposed to be position-adjustable relative to the proximate segment 121 along the length, and is slidable along the proximate segment 121 so as to be movable toward and away from the proximate segment 121, thereby permitting retraction and extension of the first and second arms 12 relative to the mounting seat 11 in the second direction. The distal segment 122 has a resilient engaging portion 124 that is configured to engage detachably a selected one of the retaining holes 123 in the proximate segment 121 for retaining the distal segment 122 on the proximate segment 121, and a grip portion 125 opposite to the engaging portion 124 along the length. When the first and second arms 12 are extended in the second direction in a position of use, the grip portions 125 of the distal segments 122 of the first and second arms 12 may be pushed toward the respective proximate segments 121 to abut against the lateral edges of the backrest 201 of the chair 2 to thereby firmly arrest movement of the mounting member relative to the chair 2. As the first and second arms 12 are extendable and retractable in the second direction, the hanger assembly 1 can be adapted for use with backrests 201 of different widths. Besides, as the proximate segments 121 of the first and second arms 12 are turnable relative to the mounting seat 11, the proximate segments 121 together with the respective distal segments 122 retained thereon can be brought to be disposed close to the mounting seat 11 in a folded position to facilitate carrying and storage.

The upright bar 20 is coupled to the mounting seat 11, extends in the upright direction, and has a front surface 213 and a rear surface 214 opposite to the front surface 213 in the first direction. The front surface 213 has a plurality of positioning holes 211 that are displaced from one another in the upright direction and that extend towards the rear surface 214. The rear surface 214 is disposed to confront the front side surface 110 of the mounting seat 11.

The hanging member 30 is disposed on the upright bar 20 and is adapted for hanging the garment 3. In this embodiment, the hanging member 30 is a triangular clothes hanger body mounted on a top end of 212 of the upright bar 20 through threaded engagement.

The mounting member further includes a coupling seat 112 that has an outer surface 1121 and an inner surface 1122 which is opposite to the outer surface 1121 in the first direction, which is disposed to confront the front surface 213 of the upright bar 20, and which has a bore 1120 extending through the outer surface 1121. The coupling seat 112 is configured to complement and to couple with the mounting seat 11 such that, after assembly, a part of the coupling seat 112 straddles the opposite sides of the mounting seat 11 to sandwich the upright bar 20 between the mounting seat 11 and the coupling seat 112. The coupling seat 112 is movable in the first direction between a clamping position, where the coupling seat 112 urges the rear surface 214 of the upright bar 20 to engage the front side surface 110 of the mounting seat 11, and a releasing position, where the rear surface 214 of the upright bar 20 is disengaged from the front side surface 110 of the mounting seat 11 so as to permit movement of the upright bar 20 in the upright direction between an upper position and a lower position.

The embodiment further includes a retaining latch 113, an abutment member 115, and a biasing member 116. The retaining latch 113 has a shank 1131 disposed in the bore 1120 and extending in the first direction to engage a selected one of the positioning holes 211 in the upright bar 20 in one of upper and lower positions to thereby place the coupling seat 112 in the clamping position, and a head portion 114 extending from the shank 1131 and outwardly of the outer surface 1121 of the coupling seat 112.

The abutment member 115, which is a C-clip in this embodiment, is disposed on the shank 1131 and is distal from the head portion 114. The abutment member 115 is received in an annular groove 117 formed in the shank 1131 proximate to a distal end of the shank 1131.

The biasing member 116 is disposed to bias the coupling seat 112 towards the clamping position, and is a coiled spring which is sleeved on the shank 1131 and which has one end proximate to the outer surface 1121 of the coupling seat 112 and an opposite end abutting against the abutment member 115. As such, when the retaining latch 113 is pulled at the head portion 114, the abutment member 115 moves towards the outer surface 1121 of the coupling seat 112 against biasing action of the coiled spring 116 to disengage the shank 1131 from the selected one of the positioning holes 211 in the upright bar 20 to place the coupling seat 112 in the releasing position, thereby permitting movement of the upright bar 20 in the upright direction.

With the aforesaid construction of the present invention, when the hanger assembly 1 is to be attached to the backrest 201 of the chair 2, the first and second arms 12 are extended full length in the second direction by sliding the distal segment 122 of each of the first and second arms 12 outward along the respective proximate segment 121. Then, the hooking member 111 is caused to engage the top edge of the backrest 201. Next, the first and second arms 12 are pushed inwardly until the grip portions 125 respectively abut against the lateral edges of the backrest 201 to thereby firmly position the hanger assembly 1 on the chair 2. Accordingly, the garment 3 can be hung neatly on the hanging member 30.

Figure 4:
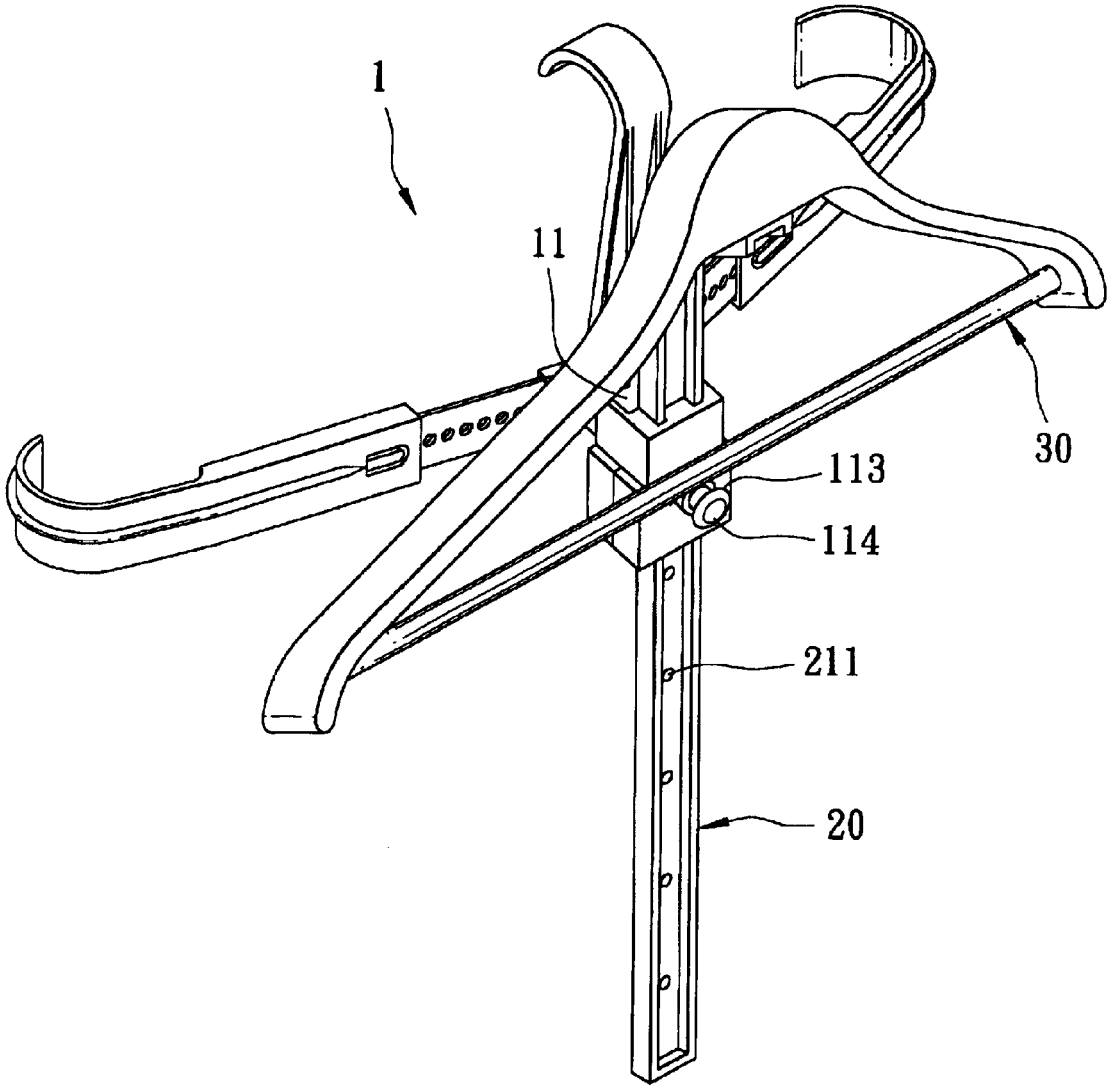
FIG. 4 is a perspective view of the first preferred embodiment, illustrating an upright bar in a lower position.

The position of the upright bar 20 relative to the mounting seat 11 is adjustable by means of the retaining latch 113, as shown in FIG. 4, so as to be adapted for hanging garments of different lengths.

Figure 5:
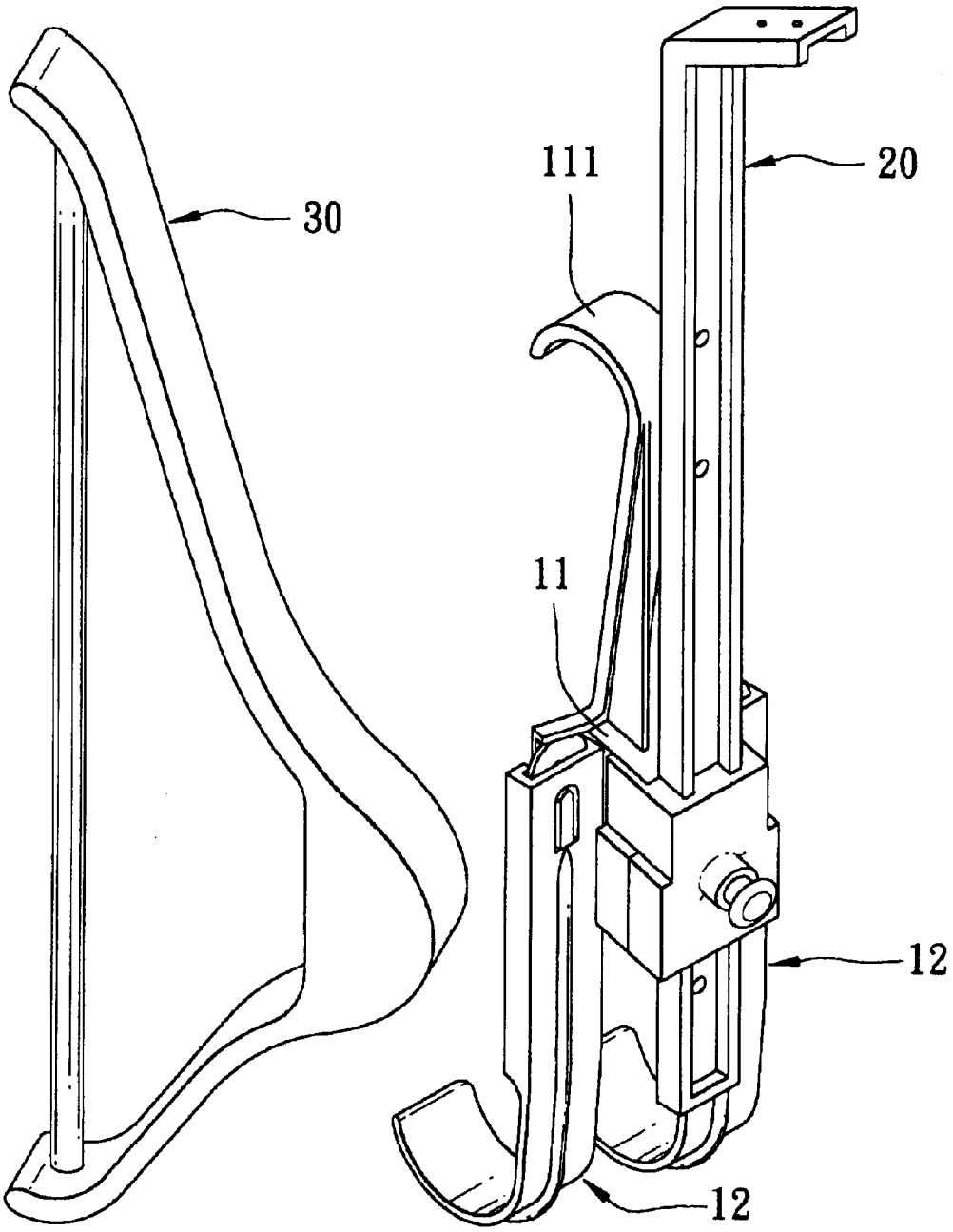
FIG. 5 is a perspective view of the first preferred embodiment in a disassembled state.

Referring to FIG. 5, to facilitate carrying and storage, the first and second arms 12, which are connected pivotally to the mounting seat 11, can be folded against the mounting seat 11, and the hanging member 30, which is connected threadedly to the upright bar 20, can be detached from the upright bar 20.

Figure 6:
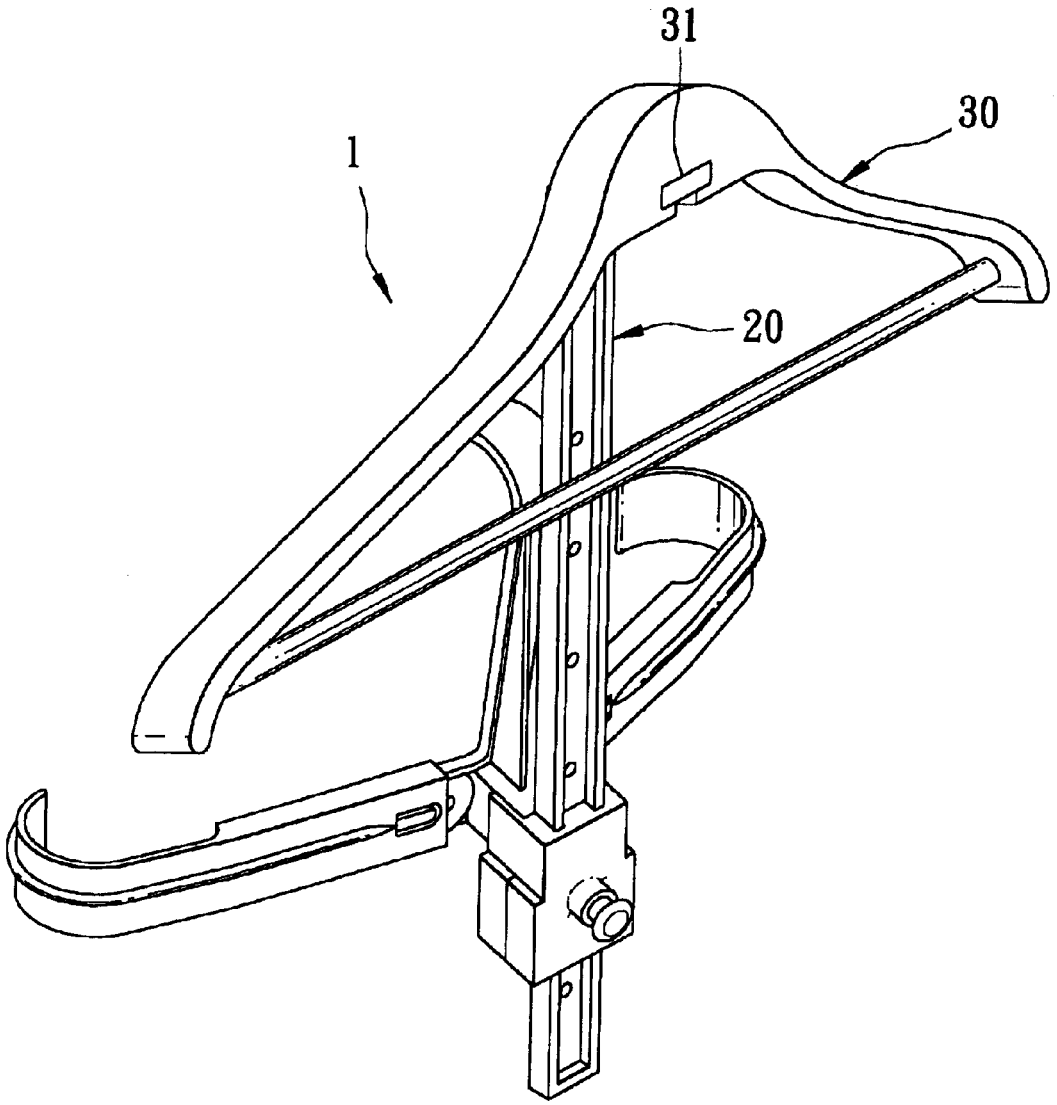
FIG. 6 is a perspective view of the second preferred embodiment of a hanger assembly according to the present invention.

FIG. 6 shows the second preferred embodiment of a hanger assembly 1 according to the present invention. As shown, this embodiment is substantially similar to the previous embodiment except that the hanging member 30 has an upper portion formed with a slot 31 for engaging the top end 212 (not visible) of the upright bar 20 to further facilitate assembly.

Figure 7:
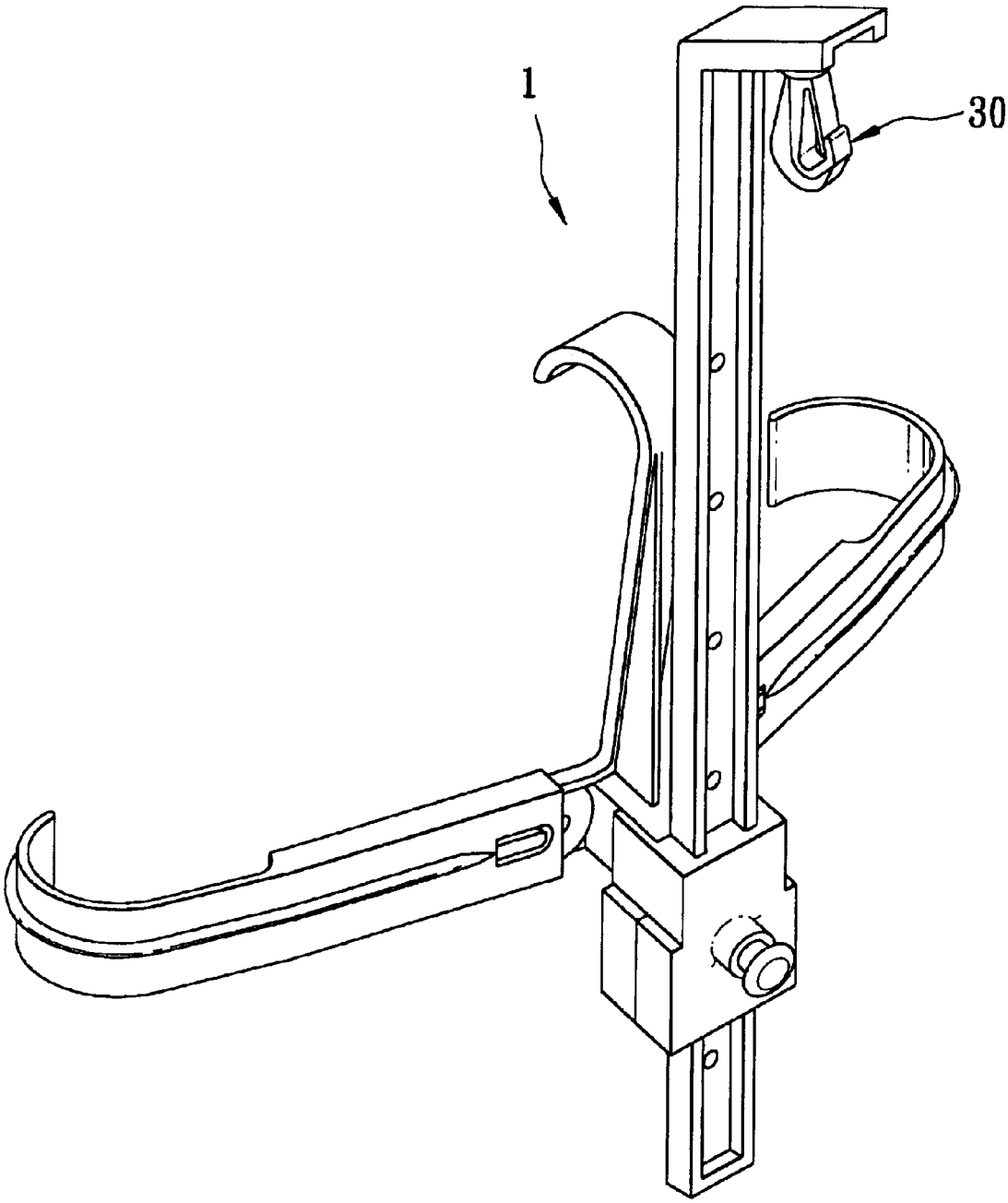
FIG. 7 is a perspective view of the third preferred embodiment of a hanger assembly according to the present invention.

FIG. 7 shows the third preferred embodiment of a hanger assembly 1 according to the present invention, which is substantially similar to the first preferred embodiment. The main difference therebetween resides in that the hanging member 30 is a hook.

Figure 8:
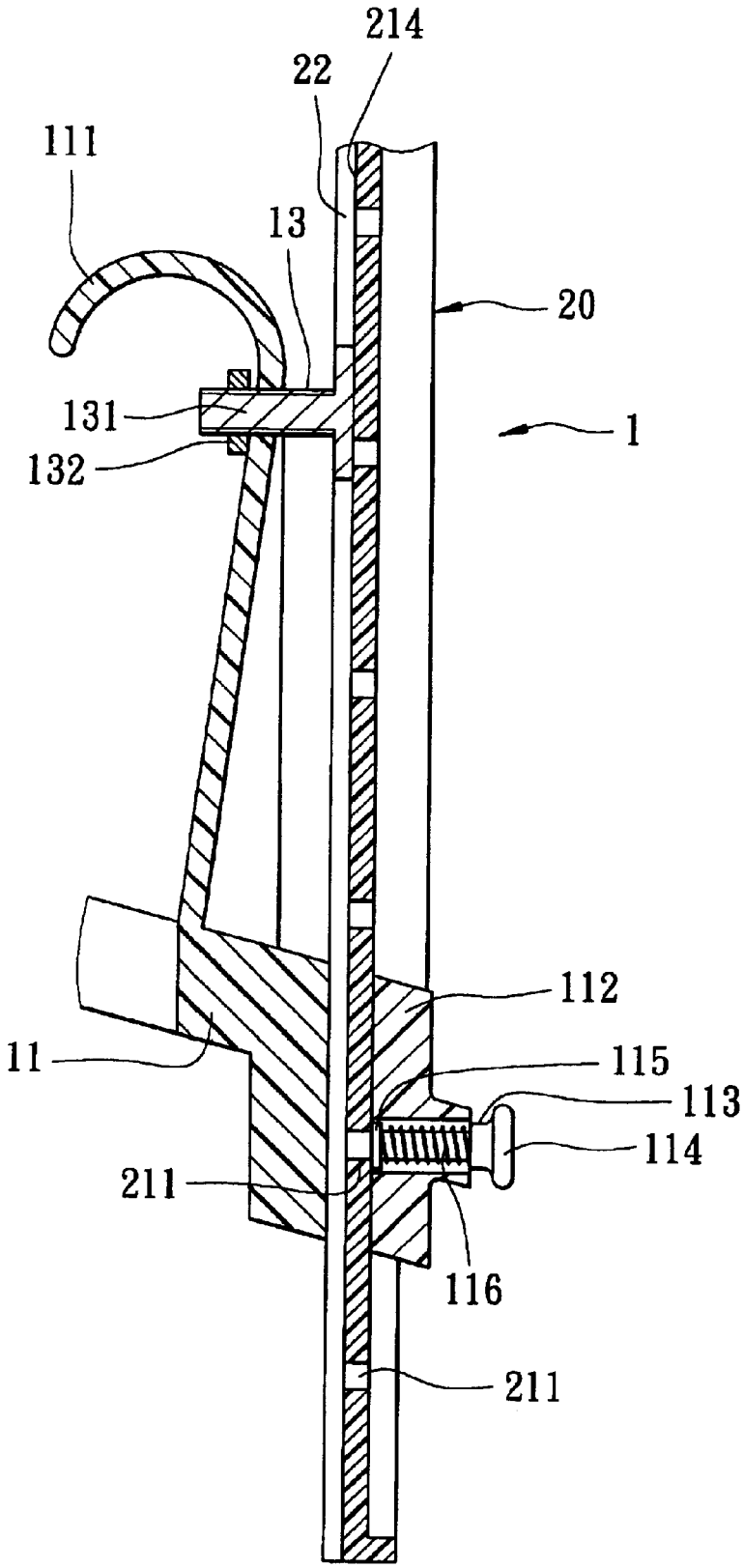
FIG. 8 is a fragmentary sectional view of the fourth preferred embodiment of a hanger assembly according to the present invention.

FIG. 8 shows the fourth preferred embodiment of a hanger assembly 1 according to the present invention, which is substantially similar to the first preferred embodiment. As shown, this embodiment further includes a positioning member 13. The rear surface 214 of the upright bar 20 is formed with a slideway 22 extending in the upright direction. The positioning member 13 includes a key 131 with a head end retained slidably in the slideway 22 and a threaded shank extending through the hooking member 111, and a nut 132 for engaging threadedly the threaded shank, thereby positioning the upright bar 20 on the hooking member 111. Since the upright bar 20 is held between the coupling seat 112 and the mounting seat 11 by the positioning member 13, as well as the retaining latch 1113, stability of the upright bar 20 is ensured.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A hanger assembly adapted for hanging from a backrest of a chair, the backrest having a top edge and two opposite lateral edges, said hanger assembly comprising:

a mounting member including a mounting seat extending in an upright direction and having front and rear side surfaces that are respectively distal from and proximate to the backrest and that are opposite to each other in a first direction that is transverse to the upright direction;

a hooking member extending upwardly from said mounting seat and terminating at a hook that is adapted to engage the top edge of the backrest;

a gripping arm unit coupled to said mounting seat and including a first arm of a length, said first arm having proximate and distal segments relative to said mounting seat, said distal segment being disposed to be position-adjustable relative to said proximate segment along the length such that when said first arm extends in a second direction transverse to both the upright direction and the first direction in a position of use, said distal segment is movable toward said proximate segment so as to be adapted to be pushed against a respective one of the lateral edges of the backrest, thereby firmly arresting movement of said mounting member relative to the chair;

an upright bar coupled to said mounting seat and extending in the upright direction; and a hanging member disposed on said upright bar and adapted for hanging an article.

2. The hanger assembly as defined in claim 1, wherein said proximate segment is provided with a series of spaced-apart retaining holes along the length, said distal segment being retained on and being slidable along said proximate segment so as to be movable toward and away from said proximate segment, thereby permitting retraction and extension of said gripping arm unit relative to said mounting seat in the second direction, said distal segment having an engaging portion configured to engage detachably a selected one of said retaining holes for retaining said distal segment on said proximate segment, and a grip portion opposite to said engaging portion along the length and adapted to be pushed against a respective one of the lateral edges of the backrest.

3. The hanger assembly as defined in claim 2, wherein said proximate segment is connected pivotally to said mounting seat so as to be turnable relative to said mounting seat between the position of use, where said grip portion is adapted to abut against the respective one of the lateral edges of the backrest, and a folded position, where said grip portion is disposed close to said mounting seat.

4. The hanger assembly as defined in claim 3, wherein said gripping arm unit further includes a second arm of a construction symmetrical to said first arm, said first and second arms being connected respectively to two opposite sides of said mounting seat in the second direction.

5. The hanger assembly as defined in claim 4, wherein said upright bar is displaceable retainingly in the upright direction.

6. The hanger assembly as defined in claim 5, wherein said upright bar has a front surface and a rear surface opposite to said front surface in the first direction and disposed to confront said front side surface of said mounting seat, said mounting member further including a coupling seat that is movable in the first direction between a clamping position, where said coupling seat urges said rear surface of said upright bar to engage said front side surface, and a releasing position, where said rear surface is disengaged from said front side surface so as to permit movement of said upright bar in the upright direction between an upper position and a lower position, said hanger assembly further comprising a biasing member disposed to bias said coupling seat towards the clamping position.

7. The hanger assembly as defined in claim 6, wherein said front surface of said upright bar has a plurality of positioning holes that are displaced from one another in the upright direction and that extend towards said rear surface, said coupling seat having an outer surface and an inner surface which is opposite to said outer surface in the first direction, which confronts said front side surface of said mounting seat, and which has a bore extending through said outer surface, said hanger assembly further comprising a retaining latch that has a shank disposed in said bore and extendable in the first direction to engage a selected one of said positioning holes so as to position said upright bar in one of the upper and lower positions, and a head portion extending from said shank and outwardly of said outer surface of said coupling seat, and an abutment member disposed on said shank and distal from said head portion, wherein said biasing member is a coiled spring which is sleeved on said shank and which has one end proximate to said outer surface and an opposite end abutting against said abutment member such that when said head portion is pulled, said abutment member moves towards said outer surface against biasing action of said coiled spring to disengage said shank from said selected one of said positioning holes to place said coupling seat in the releasing position, thereby permitting movement of said upright bar in the upright direction.

8. The hanger assembly as defined in claim 1, wherein said upright bar has a top end, said hanging member being a triangular hanger body that is connected to said top end of said upright bar by threaded engagement.

9. The hanger assembly as defined in claim 1, wherein said upright bar has a top end, said hanging member being a triangular hanger body that has an upper portion formed with a slot for engaging said top end of said upright bar.

10. The hanger assembly as defined in claim 1, wherein said hanging member is a hook.

11. The hanger assembly as defined in claim 1, wherein said upright bar has a rear surface formed with a slideway extending in the upright direction, said hanger assembly further comprising a positioning member that includes a key with a head end retained slidably in said slideway and a threaded shank extending through said hooking member, and a nut for engaging threadedly said threaded shank, thereby positioning said upright bar on said hooking member.

* * * * *